US006283023B1

(12) United States Patent
Christmann et al.

(10) Patent No.: US 6,283,023 B1
(45) Date of Patent: Sep. 4, 2001

(54) INKING SYSTEM FOR INKING A PRINTING CYLINDER OF A ROTOGRAVURE PRINTING PRESS

(75) Inventors: Dieter Christmann, Nürnberg; Hans-Dieter Drumm, Rammelsbach; Rudolf Herb, Bodenheim/Roxheim; Werner Georg Roman Straubinger, Nürnberg, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,783

(22) PCT Filed: May 2, 1998

(86) PCT No.: PCT/DE98/01212

§ 371 Date: Feb. 9, 2000

§ 102(e) Date: Feb. 9, 2000

(87) PCT Pub. No.: WO98/50233

PCT Pub. Date: Nov. 12, 1998

(30) Foreign Application Priority Data

May 5, 1997 (DE) ..... 197 18 587

(51) Int. Cl.[7] ..... B41F 9/00; B41F 9/10; B41F 31/00

(52) U.S. Cl. ..... 101/153; 101/157; 101/350.1; 101/350.6

(58) Field of Search ..... 101/157, 169, 101/363–366, 350.1, 152, 153, 167, 207–210, 425, 350.6

(56) References Cited

U.S. PATENT DOCUMENTS

| | | | | |
|---|---|---|---|---|
| 1,633,691 | | 6/1927 | Brueshaber . | |
| 3,630,146 | * | 12/1971 | Shields | 101/351 |
| 3,793,952 | * | 2/1974 | Neumann et al. | 101/157 |
| 5,103,723 | * | 4/1992 | Maier | 101/153 |
| 5,497,700 | | 3/1996 | Herb . | |

FOREIGN PATENT DOCUMENTS

| | | |
|---|---|---|
| 604870 | 11/1934 | (DE) . |
| 2139834 | 9/1972 | (DE) . |
| 4340128 C2 | 7/1996 | (DE) . |
| 383135 | 2/1932 | (GB) . |

* cited by examiner

*Primary Examiner*—Kimberly L. Asher
(74) *Attorney, Agent, or Firm*—Jones, Tullar & Cooper, PC

(57) ABSTRACT

In an inking system of a rotogravure printing press there are included an ink reservoir, an ink doctor blade device and an ink catch reservoir. All of these components of the inking system are height-adjustable with respect to the formed cylinder of the printing machine.

9 Claims, 1 Drawing Sheet

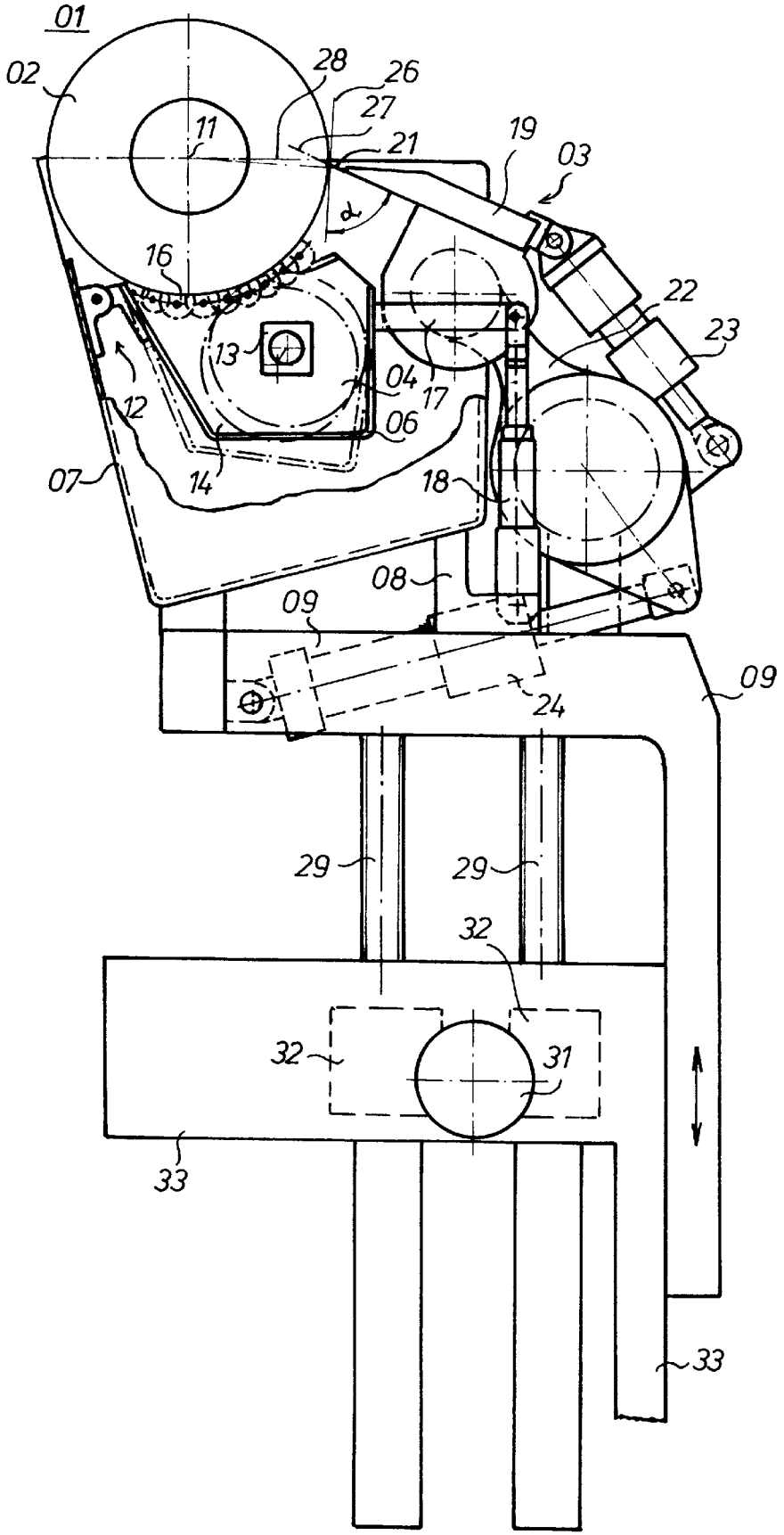
01
02
28
26
27
11
21
19
03
α
16
22
23
13
04
17
12
06
07
14
18
08
09
09
24
29
29
32
32
31
33
33

INKING SYSTEM FOR INKING A PRINTING CYLINDER OF A ROTOGRAVURE PRINTING PRESS

FIELD OF THE INVENTION

The present invention relates to an inking unit for inking a printing or formed cylinder of a rotogravure printing press. The inking unit includes a doctor blade device, an ink reservoir and a catch reservoir. Both the ink and catch reservoirs are height-adjustable.

DESCRIPTION OF THE PRIOR ART

DE 43 40 128 C2 describes an inking unit for a rotary rotogravure printing press with a height-adjustable ink reservoir and inking roller.

DE-AS 21 39 834 discloses an inking unit for a rotogravure printing press, wherein an ink reservoir and a doctor blade device are arranged on a height-adjustable work platform.

SUMMARY OF THE INVENTION

The present invention is based on the object of producing an inking unit for a rotogravure printing press.

In accordance with the invention, this object is attained by providing an inking unit that essentially consists of a doctor blade device, an ink reservoir and a catch reservoir. The ink reservoir is height-adjustable and the catch reservoir is also height-adjustable.

The advantages which can be obtained by means of the present invention reside, in particular, in that printing or formed cylinders with diameters of different sizes can be employed in a height-adjustable inking unit. Because of this, adjustment work previously required on account of differing diameters of the printing or formed cylinders is minimized.

BRIEF DESCRIPTION OF THE DRAWING

A preferred embodiment of the present invention is represented in the sole drawing FIGURE and will be described in greater detail in what follows.

DESCRIPTION OF THE PREFERRED EMBODIMENT

An inking unit 01 for use in inking a printing or formed cylinder 02 of a rotary rotogravure printing press is depicted in the sole drawing figure and essentially consists of a doctor blade device 03, an inking roller 04 and an ink reservoir 06. In addition to the first ink reservoir 06 for inking the printing or formed cylinder 02, a second ink reservoir, which is embodied as a catch reservoir 07, is provided and is arranged below the first ink reservoir 06. This catch reservoir 07 surrounds the ink reservoir 06. A width of the catch reservoir 07 extends at least sufficiently far so that ink dripping off the doctor blade device 03 is dependably conducted into the catch reservoir 07. This catch reservoir 07 is fastened, by means of a holder 08, on a height-adjustable platform 09.

The ink reservoir 06 is supported, pivotable in the radial direction of the printing or formed cylinder 02 and in relation to this catch reservoir 07, parallel with an axis of rotation 11 of the printing or formed cylinder 02 by means of a pivot joint 12.

The inking roller 04 is rotatably seated inside the ink reservoir 06 in two bearings 13, which are spring-mounted in respect to the ink reservoir 06.

A chain 16, which works together with the printing or formed cylinder 02 and provides a seal in the axial direction for preventing the lateral exit of ink, is respectively provided on both lateral cheeks or end faces 14 of the ink reservoir 06.

A lever 17 is arranged on the ink reservoir 06, and works in cooperation with an actuating drive, for example a work cylinder 18. This work cylinder 18 is hingedly seated, at a lower end, on the height-adjustable platform 09. In this way, the ink reservoir 06, the inking roller 04 and the chains 16 are together pivotably seated, i.e. height-adjustable, in relation to the catch reservoir 07. The inking roller 04 can therefore be placed against the printing or formed cylinder 02 by actuation of the work cylinder 18.

The doctor blade device 03 essentially consists of a doctor blade holder 19 with a doctor blade 21 and a doctor bladesupport 22, as well as two actuating devices which can take the form of upper and lower doctor blade actuating work cylinders 23 and 24, respectively. The doctor blade holder 19 is pivotably seated on one end of the doctor blade support 22 parallel with the axis of rotation 11 of the printing or formed cylinder 02. The upper doctor blade actuating work cylinder 23, which is seated on the doctor blade support 22, acts on the doctor blade holder 19. The doctor blade 21 can be brought in and out of contact with the printing or formed cylinder 02 by means of this upper doctor blade actuating work cylinder 23. This upper work cylinder 23 can work together with a stop, which can be displaced by a motor, for limiting the stroke. The doctor blade support 22 and the doctor blade holder 19 are seated, displaceable in the axial direction of the printing or formed cylinder 02, by means of a drive motor, not represented. The doctor blade 21, the doctor blade holder 19, the doctor blade support 22 and the upper work cylinder 23 move traversingly during the operation.

The doctor blade support 22 is pivotably seated in relation to the platform 09 parallel with the axis of rotation 11 of the printing or formed cylinder 02. The lower doctor blade actuating work cylinder 24 seated on the platform 09 acts on this doctor blade support 22. A setting angle $\alpha$ can be set by means of this lower work cylinder 24. The lower work cylinder 24 moves indirectly or directly against a stop, not represented, which can be displaced by a motor. This setting angle $\alpha$ is determined by the intersection of a tangential line 26 tangent to the contact point of the doctor blade 21 with the printing or formed cylinder 02, and by a straight line 27, which extends parallel with the doctor blade 21. This setting angle $\alpha$ is 60° to 80°, for example. The contact zone between the doctor blade 21 and the printing or formed cylinder 02 lies below a horizontal line 28 extending through the axis of rotation 11 of the printing or formed cylinder 02.

The platform 09, which supports the ink catch reservoir 07, is height-adjustable by means of threaded spindles 29 and in this way is adaptable to various diameters of the exchangeable printing or formed cylinder 02.

In the present preferred embodiment, three threaded spindles 29, which are synchronized with each other, are provided in the axial direction of the printing or formed cylinder 02 for support of the height-adjustable platform 09. The threaded spindles 29 are driven by means of a common actuating drive 31. In the present preferred embodiment, spindle lifting gears 32 are provided for adjustment. These spindle lifting gears 32 are arranged in a lateral frame 33 of the rotogravure printing press. Thus, the platform 09 can be positioned in relation to the printing or formed cylinder 02 in the radial direction of the latter.

The ink reservoir 06, the doctor blade device 03 and the catch reservoir 07 are arranged on a platform 09 and can therefore together be adjusted in height by means of an actuating drive 31.

The inking roller 04 can be height-adjusted in respect to the catch reservoir 07, and therefore in respect to the platform 09.

The setting angle $\alpha$ of the doctor blade 21 against the formed cylinder 02 can be changed.

While a preferred embodiment of an inking system for inking a printing or formed cylinder of a rotogravure printing machine in accordance with the present invention has been set forth fully and completely hereinabove, it will be apparent to one of skill in the art that a number of changes in, for example the drive for the printing or formed cylinder, the arrangement for the supply of ink to the ink reservoir and the like could be made without departing from the true spirit and scope of the present invention which is accordingly to be limited only by the following claims.

What is claimed is:

1. An inking unit adapted for use with a rotogravure printing press including a printing cylinder, said inking unit comprising:

an ink reservoir;

a doctor blade device supported for movement with respect to said ink reservoir and adapted to be engageable with the printing cylinder;

an ink catch reservoir positioned below said ink reservoir and said doctor blade device;

a support for said ink reservoir, said support supporting said ink reservoir for movement in said ink catch reservoir; and a platform supporting said ink catch reservoir for height adjustment with respect to the printing cylinder.

2. The inking unit of claim 1 further including a doctor blade support for supporting said doctor blade device for adjustment with respect to the printing cylinder.

3. The inking unit of claim 1 wherein said ink reservoir is height adjustable with said ink catch reservoir.

4. The inking unit of claim 1 wherein said ink reservoir and said doctor blade device are height adjustable together with said ink catch reservoir.

5. The inking unit of claim 1 wherein said ink reservoir is height adjustable with respect to said ink catch reservoir.

6. The inking unit of claim 1 wherein said doctor blade device includes a doctor blade, said doctor blade being adapted to contact the printing cylinder in a contact zone, said contact zone being arranged below a horizontal line passing through an axis of rotation of the printing cylinder.

7. The inking unit of claim 1 wherein said platform supporting said ink catch reservoir for height adjustment includes an actuating drive.

8. The inking unit of claim 7 wherein said actuating drive includes at least one threaded spindle.

9. The inking unit of claim 1 further including an inking roller supported in said ink reservoir.

* * * * *